United States Patent [19]

Fazakerley

[11] 4,186,903

[45] Feb. 5, 1980

[54] PAINTER'S FIXTURE

[76] Inventor: Herbert M. Fazakerley, 16 Westdale Rd., Canton, Mass. 02021

[21] Appl. No.: 795,300

[22] Filed: May 9, 1977

[51] Int. Cl.[2] ..... E06C 7/14

[52] U.S. Cl. ..... 248/210; 248/226.5

[58] Field of Search ..... 248/224.3, 210, 211, 248/225.3, 226.5, 302; 85/5 R, 80

[56] References Cited

U.S. PATENT DOCUMENTS

| | | | |
|---|---|---|---|
| 1,015,183 | 1/1912 | Hering | 248/302 |
| 1,551,243 | 8/1925 | Dick | 248/210 |
| 3,223,369 | 12/1965 | Benninger, Jr. | 248/210 |
| 3,246,867 | 4/1966 | Ewing | 248/210 |
| 3,273,845 | 9/1966 | Jepsen | 248/226.5 |
| 3,420,486 | 1/1969 | Baker | 248/210 |
| 3,458,165 | 7/1969 | Crow | 248/210 |

FOREIGN PATENT DOCUMENTS

| | | | |
|---|---|---|---|
| 252022 | 5/1964 | Australia | 85/5 R |
| 683720 | 12/1952 | United Kingdom | 248/210 |

*Primary Examiner*—Roy D. Frazier
*Assistant Examiner*—Peter A. Aschenbrenner
*Attorney, Agent, or Firm*—Joseph H. Killion

[57] ABSTRACT

I have discovered a painter's fixture for a hollow ladder rung comprising a base member and insert section at one end of said base member movable between a first expandable open position and a second contractable closed position, compressing against the inner surface of said hollow ladder rung to retain the fixture in place. Means are provided to detachably attach a paint-brush having a hole in the handle thereof to the base member.

2 Claims, 3 Drawing Figures

PAINTER'S FIXTURE

BACKGROUND OF THE INVENTION

OUTLINE:

Painting from a ladder is something familiar to most homeowners. A number of fixtures adaptable to a ladder to hold the paint-brush and paintbucket have been developed over the years. There are serious disadvantages with these devices.

U.S. Pat. No. 1,221,658 discloses an article support for ladders. This device is complicated one having a clamping means fastened to a wooden ladder and a levelling plate on which to rest the paint-can handle. There is no provision in this device to place a paint-brush, e.g. over the bucket so that it does not drip haphazardly. In addition, the levelling plate is very susceptible to spoilage of paint. The device overall needs constant adjustment as the painter goes up or down the ladder, and is expensive to manufacture.

U.S. Pat. No. 1,865,283 discloses a simplified brush and bucket holder. This device is multi-hook device with one hook going over a ladder rung and the other hook squeezing around a ladder rung in a horizontal direction and having a brush holder over a bucket. A major problem with this device is that as the painter goes higher, the distance between the building and the ladder decreases and there is less and less room for the brush and bucket holder. With this device the painter has to come down several rungs of the ladder to dip his brush. Also, this device makes no accommodation for the fact that the painter is right or left-handed making it cumbersome in use.

U.S. Pat. No. 3,822,846 shows a more modern device wherein the housing elements are basically similar but the device attached to the ladder is a paint-roller tray. As with the other devices this device does not allow for usage with the ever more popular aluminum ladder. Aluminum is not compressible like wood, with the result that these clamping devices dent and mar the aluminum.

There is then a need for a paint-brush and can-holder which is adaptable to an aluminum ladder, which takes into account the left and right-handed painter and which further solves the problem of decreasing distance between the ladder and the building, as the painter goes up the ladder.

SUMMARY OF INVENTION

My invention relates to an improved painter's fixture.

I have discovered an improved painter's fixture for a hollow rung ladder which comprises a base member forming an insert section at one end of said base member which is movable between a first expandable open position and a second contractable closed position, pressing against the inner surface of said hollow ladder rung to retain the holder in place, and having an upward extending end thereto to halt insertion of said holder into said hollow ladder rung. Means are included to detachably attach a paint-brush and paint-can to the base member.

Preferably and optionally, my paint-brush holder and buck and paint-can device is employed with a thumbscrew joining a two sectional base member which allows the outer portion holding the paint-brush and can to be adjusted to a comfortable position.

The base member is formed at one end into an insert section having a substantially perpendicular extending end thereof. This insert section is squeezed and inserted into the hollow rung of the aluminum ladder. When it is released it presses against the inside of the hollow rung giving a firm support to the painter's fixture. The length of the insert section is important in that it must be sufficient to maintain stability of the painter's fixture. The function of the substantially perpendicular extending end is to prevent further insertion. The base member must be strong enough to bear the weight of the loaded paint-can together with the brush. Preferably metal, particularly steel and more particularly a spring steel is utilized.

The other end of the base member is formed, particularly, twisted to form a substantially perpendicular section thereof to which is affixed the paint-can and brush-holder. I prefer that this twist not only changes the base member from substantially horizontal to substantially vertical but also imparts a change in the longitudinal plane thereof. By this means the painter's fixture can be manufactured to accommodate right or left-handed painters.

It is preferred that the paint-can holder, described further in the preferred embodiment, comprise a roll-lip device affixed on one end to the base member and curling up on the outside to provide support for a paint-can. This eliminates the need for a base support underneath the paint-can.

The paint-brush holder which is affixed to the opposite side of the base member from the rolling paint-can lip is upwardly extending and ends in a hook. Paint-brushes are relatively standard in having a $\frac{1}{4}''$ hole in the paint-brush so the hook is adapted to support the vast majority of paint-brushes. The hook allows the handle of a brush to be hung thereon and is retained with its wet end pointed toward and above the can.

My invention provides numerous advantages over those devices found in the prior art.

It is an advantage of my invention that it can be used with aluminum ladders and does not have a clamping means which would dent aluminum ladders.

Another advantage of my invention is that there is no plate to hold the paintbucket. My rolling-lip holder simply holds it while allowing it to adjust to gravity.

My invention also provides the advantage that it may be utilized near the top of the ladder and may be adapted for right-handed or left-handed painters.

Further advantages of my invention are that it is stable, durable, economical and efficient.

DETAILED DESCRIPTION OF THE DRAWINGS

Figure 1:
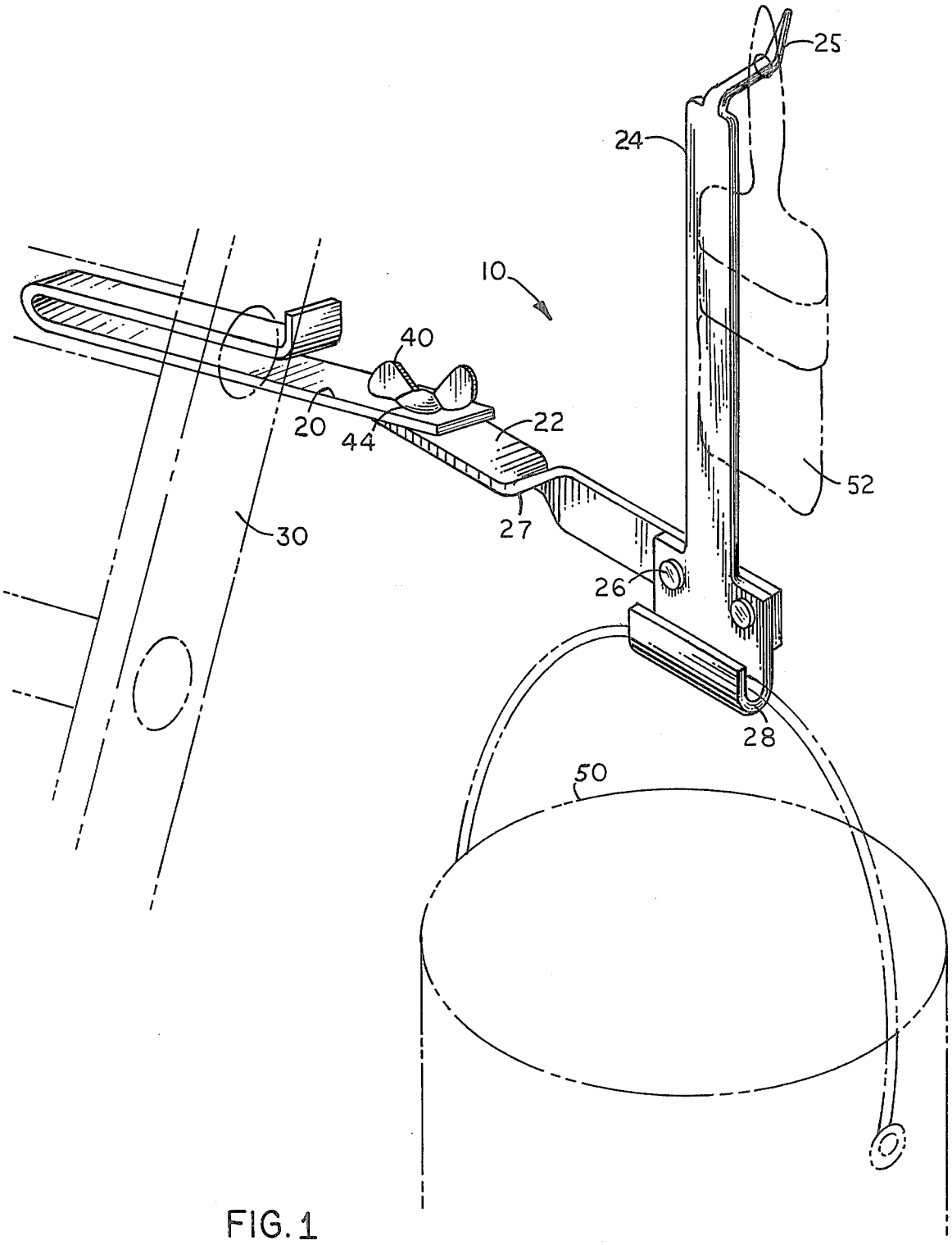
FIG. 1 is a perspective view of the painter's fixture showing the fixture in assembled condition mounted in a ladder (portion shown dotted).
Figure 2:
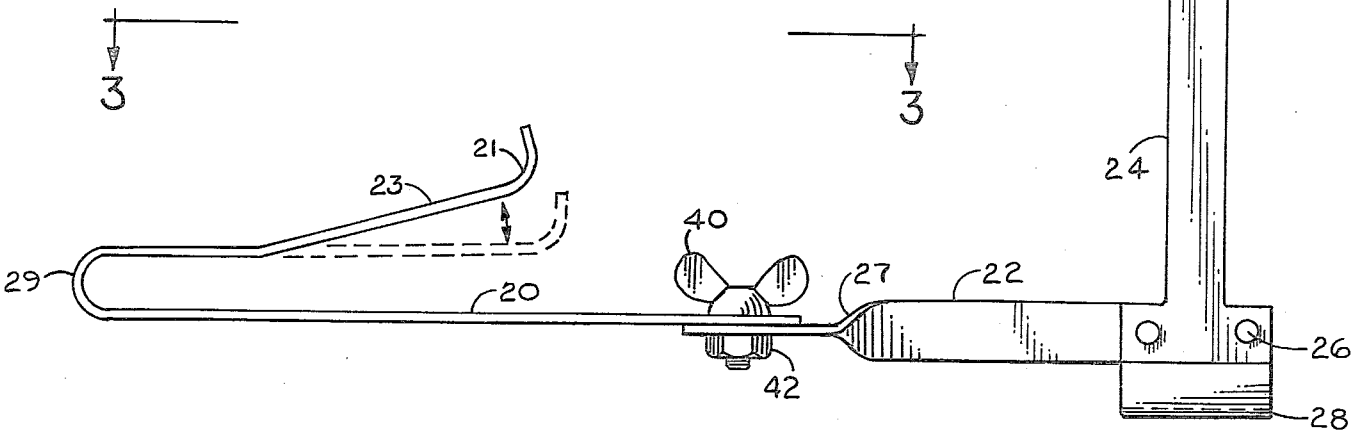
FIG. 2 is a side illustrative view of the fixture showing the compression/expansion of the insert section.

Referring now in particular to the accompanying drawings, my painter's fixture is generally indicated in FIG. 1 at 10, and includes a first plate element 20, which is formed into insert section 29 (FIG. 2) having upwardly extending section 23 (FIG. 2) and perpendicular lip 21 (FIG. 2).

Second plate element 22, extends horizontally for a portion thereof then forces twist 27 and becomes vertical for the remainder thereof.

Paint-brush and paint-can holder 24, describes brush hook 25, holding paint-brush 52 (dotted) at one end thereof and at the other end thereof forms rolling lip section 28 holidng paint-can 50 (dotted). Rivits 26, join the paint-brush and paint-can holder to the second plate element.

Thumb-screw 40, fitted through plate aperture 44, which passes through both plate elements and having nut 42 (FIG. 2) is tightened when the proper angle is reached.

The painter's bracket joins with ladder 30 in rung hole 32.

FIG. 2 shows that insert section 29, is movable by the normal spring action in a metal like steel. It might be required but it does not appear at the present that spring steel be used in my painter's fixture.

Figure 3:
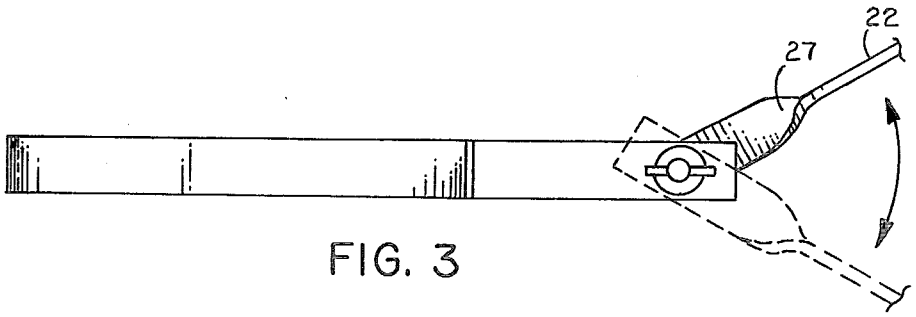
FIG. 3 is a partially fragmented, top, perspective view of the thumbscrew adjustment taken along line 3—3 of FIG. 2 showing the adjustment.

FIG. 3 shows the range of adjustment around the thumb-screw.

Typically in use the insert section of the painter's fixture is depressed, inserted into the hollow rung of the aluminum ladder to the proper depth and released, allowing the insert section to contact and compress against the inside of the ladder rung. The perpendicular end of the insert section prevents over insertion.

The thumbscrew is released to move the second plate element into the desired position depending on whether the painter is right or left-handed. The paint-can and brush can then be hung on their respective rests.

As the painter moves up the ladder he depresses the perpendicular end of the insert section, releases the painter's fixture and inserts it into another hollow ladder rung.

If, when the painter is reaching the top of the ladder the paint-can and brush are too close to the building, an adjustment of the thumbscrew can move it further from the building.

What I claim is:

1. A painter's fixture for a hollow ladder rung comprising:

(a) a base member having an insert section at one end thereof, then extending substantially horizontally for a portion thereof, then twisted and extending in a substantially perpendicular portion to the end thereof, said insert section moveable between a first expandable open position and a second contractable closed position, compressing against the inner surface of said hollow ladder rung to retain the fixture in place;

(b) means to detachably attach a paint-brush by a hole in the handle thereof, including a holder member formed at an upper end with a hook to engage said paint-brush by the hole in the handle thereof and forming a broadened upwardly curling tip thereof to engage a paint-can handle when holder member is fixed to said base member, generally perpendicular and generally vertically to said substantially perpendicular portion of said base member.

2. The painter's fixture for a hollow ladder rung of claim 1 wherein the said insert section further comprises an upwardly extending end thereof to halt insertion of said fixture into said hollow ladder rung beyond a prescribed depth.

* * * * *